US011097823B1

(12) United States Patent
Boks et al.

(10) Patent No.: US 11,097,823 B1
(45) Date of Patent: Aug. 24, 2021

(54) TROLLING MOTOR AND MOUNT FOR TROLLING MOTOR

(71) Applicant: Brunswick Corporation, Mettawa, IL (US)

(72) Inventors: Michael J. Boks, Grand Rapids, MI (US); John Witte, Ada, MI (US)

(73) Assignee: Brunswick Corporation, Mettawa, IL (US)

( * ) Notice: Subject to any disclaimer, the term of this patent is extended or adjusted under 35 U.S.C. 154(b) by 414 days.

(21) Appl. No.: 16/046,235

(22) Filed: Jul. 26, 2018

(51) Int. Cl.
*B63H 20/10* (2006.01)
*B63H 20/02* (2006.01)
*B63H 20/00* (2006.01)

(52) U.S. Cl.
CPC ..... *B63H 20/10* (2013.01); *B63H 20/007* (2013.01); *B63H 20/02* (2013.01)

(58) Field of Classification Search
CPC ..... B63H 20/10; B63H 20/02; B63H 20/007
See application file for complete search history.

(56) References Cited

U.S. PATENT DOCUMENTS 3,140,888 A * 7/1964 Di Salvo ..... E05B 85/247 292/48
3,750,988 A 8/1973 Lyon
3,765,369 A 10/1973 Henning
3,861,628 A * 1/1975 Krieger ..... B63H 20/007 248/642
3,865,335 A 2/1975 Roller et al.
3,930,461 A 1/1976 Brock et al.
3,954,080 A 5/1976 Weaver
3,999,500 A * 12/1976 Friedel ..... B63H 20/007 440/6
4,008,680 A * 2/1977 Alexander, Jr. ..... B63H 20/007 440/6
4,129,088 A * 12/1978 Foley, Jr. ..... B63H 20/007 248/640
4,492,395 A * 1/1985 Yamada ..... E05B 77/265 292/216

(Continued)

OTHER PUBLICATIONS

Johnson Outdoors, "Minn Kota Fortrex Bow-Mount Trolling Motor," User Manual, 2017.

(Continued)

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

A mount for a trolling motor pivots the trolling motor between a deployed position and a stowed position. The mount includes a base coupled to a deck of a watercraft and upper and lower arms pivotably coupled to the base. A bracket also couples the upper arm to the lower arm. The mount includes one of the following: (1) a deployed-position latch coupled to the upper arm or the base and a corresponding deployed-position striker pin configured to engage with the deployed-position latch in the deployed position of the trolling motor to lock the upper arm to the base; or (2) a pivotable latch and an associated latch blocker on the upper or lower arm or the base and a corresponding striker pin configured to engage with the pivotable latch in the deployed and/or stowed position of the trolling motor to lock the upper or lower arm to the base.

12 Claims, 6 Drawing Sheets

(56) References Cited

U.S. PATENT DOCUMENTS

| | | | | |
|---|---|---|---|---|
| 4,634,390 | A * | 1/1987 | Baird | B63H 20/007 248/642 |
| 4,819,905 | A | 4/1989 | McCain | |
| 4,966,566 | A * | 10/1990 | Baird | B63H 20/007 248/642 |
| 5,348,357 | A * | 9/1994 | Konchan | E05B 85/243 292/216 |
| 5,405,274 | A | 4/1995 | Cook, III | |
| 6,224,437 | B1 | 5/2001 | Griffith et al. | |
| 6,431,923 | B1 | 8/2002 | Knight et al. | |
| 6,447,348 | B1 | 9/2002 | Gilley | |
| 6,524,144 | B2 | 2/2003 | Pasley | |
| 6,808,431 | B1 | 10/2004 | Neely | |
| 7,004,804 | B2 | 2/2006 | Bernloehr et al. | |
| 7,195,526 | B2 | 3/2007 | Bernloehr et al. | |
| 7,285,029 | B1 * | 10/2007 | Janitz | B63H 20/007 440/6 |
| 7,510,450 | B1 | 3/2009 | Dresher | |
| D594,034 | S | 6/2009 | Bernloehr et al. | |
| 7,722,417 | B2 | 5/2010 | Bernloehr et al. | |
| 8,814,129 | B2 * | 8/2014 | Todd | B63H 21/30 248/642 |
| 9,296,455 | B2 | 3/2016 | Bernloehr et al. | |
| 9,969,474 | B1 | 5/2018 | Truax et al. | |
| 2005/0255761 | A1 * | 11/2005 | Bernloehr | B63H 20/12 440/6 |
| 2008/0203737 | A1 * | 8/2008 | Tomaszewski | E05B 81/56 292/216 |
| 2017/0210455 | A1 | 7/2017 | Bernloehr et al. | |

OTHER PUBLICATIONS

Mercury Marine, "MotorGuide Xi5 Wireless Edition," Operation, Maintenance, & Warranty Manual, 2013, pp. 10, 11, and 27.

* cited by examiner

TROLLING MOTOR AND MOUNT FOR TROLLING MOTOR

FIELD

The present disclosure relates to trolling motors and mounts for coupling trolling motors to watercraft in a manner that allows the trolling motor to be pivoted between a stowed position and a deployed position.

BACKGROUND

U.S. Pat. Nos. 3,999,500 and 4,008,680, which are incorporated herein by reference in entirety, disclose a pivotal mount for a trolling motor includes a deck bracket having a housing arm pivotally mounted at one end. A gear mechanism within the arm has a fixed bevel gear on the pivot arm axis meshing with a bevel gear on a rotatable torque tube. A drive bevel gear is secured to the opposite end and meshes with a gear sector on a coupling head pivotally mounted in the outer end of the arm. The head includes a swivel support element within which the trolling motor unit is rotatably mounted. The coupling head and motor unit are located between a depending propulsion position and transport position in response to the 180° swinging of the pivot arm. The torque tube is coupled to the bevel gears by sliding couplings and is coupled to a locking unit for the arm and a separate locking unit for the gear sector to lock them in the propulsion position and simultaneously release them for raising to the transport position.

U.S. Pat. No. 7,285,029, which is incorporated herein by reference in entirety, discloses a support device for a trolling motor that is attachable to an arm of the trolling motor to provide a cushion between the arm and a deck surface of a boat. This cushion inhibits bouncing of the arm of the trolling motor in response to a boat traveling over rough water or being trailered from one location to another over roads. The support device is attachable to the arm of the trolling motor without additional fasteners, such as screws or clips. It is also movable to different positions along the length of the arm of the trolling motor, thus allowing more than one support device to be attached to the trolling motor mount.

U.S. Pat. No. 7,510,450, which is incorporated herein by reference in entirety, discloses a trolling motor provided with an over-center clamping mechanism that facilitates its connection to a transom of a marine vessel. First and second clamping elements move toward or away from each other in response to manual manipulation of a handle. The use of an over-center mechanical arrangement allows quick and reliable attachment and removal of the clamping mechanism from the transom.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a mount for a trolling motor is configured to pivot the trolling motor between a deployed position and a stowed position. The mount includes a base configured to be coupled to a deck of a watercraft, an upper arm having a first end pivotably coupled to a first end of the base, and a lower arm having a first end pivotably coupled to the base between the first end of the base and an opposite, second end of the base. A bracket couples an opposite, second end of the upper arm to an opposite, second end of the lower arm. The mount further comprises one of the following: (1) a deployed-position latch coupled to one of the upper arm and the base and a corresponding deployed-position striker pin coupled to the other of the upper arm and the base and configured to engage with the deployed-position latch in the deployed position of the trolling motor to lock the upper arm to the base; or (2) a pivotable latch and an associated latch blocker on one of the upper or lower arm and the base and a corresponding striker pin on the other of the upper or lower arm and the base and configured to engage with the pivotable latch in at least one of the deployed position and the stowed position of the trolling motor so as to lock the upper or lower arm to the base.

According to another example of the present disclosure, a trolling motor includes a head unit, a propulsion unit, and a shaft coupling the head unit to the propulsion unit. A mount is configured to couple the shaft to a deck of a watercraft and to pivot the trolling motor between a deployed position and a stowed position. The mount comprises a four-pivot linkage including a bracket holding the shaft, an upper arm coupled to the bracket at a first pivot, a lower arm coupled to the bracket at a second pivot, and a base coupled to the lower arm at a third pivot and to the upper arm at a fourth pivot. The mount further comprises one of the following: (1) a deployed-position latch coupled to one of the upper arm and the base and a corresponding deployed-position striker pin coupled to the other of the upper arm and the base and configured to engage with the deployed-position latch in the deployed position of the trolling motor to lock the upper arm to the base; or (2) a pivotable latch on one of the upper or lower arm and the base and a corresponding striker pin on the other of the upper or lower arm and the base and configured to engage with the pivotable latch in at least one of the deployed position and the stowed position of the trolling motor so as to lock the upper or lower arm to the base.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
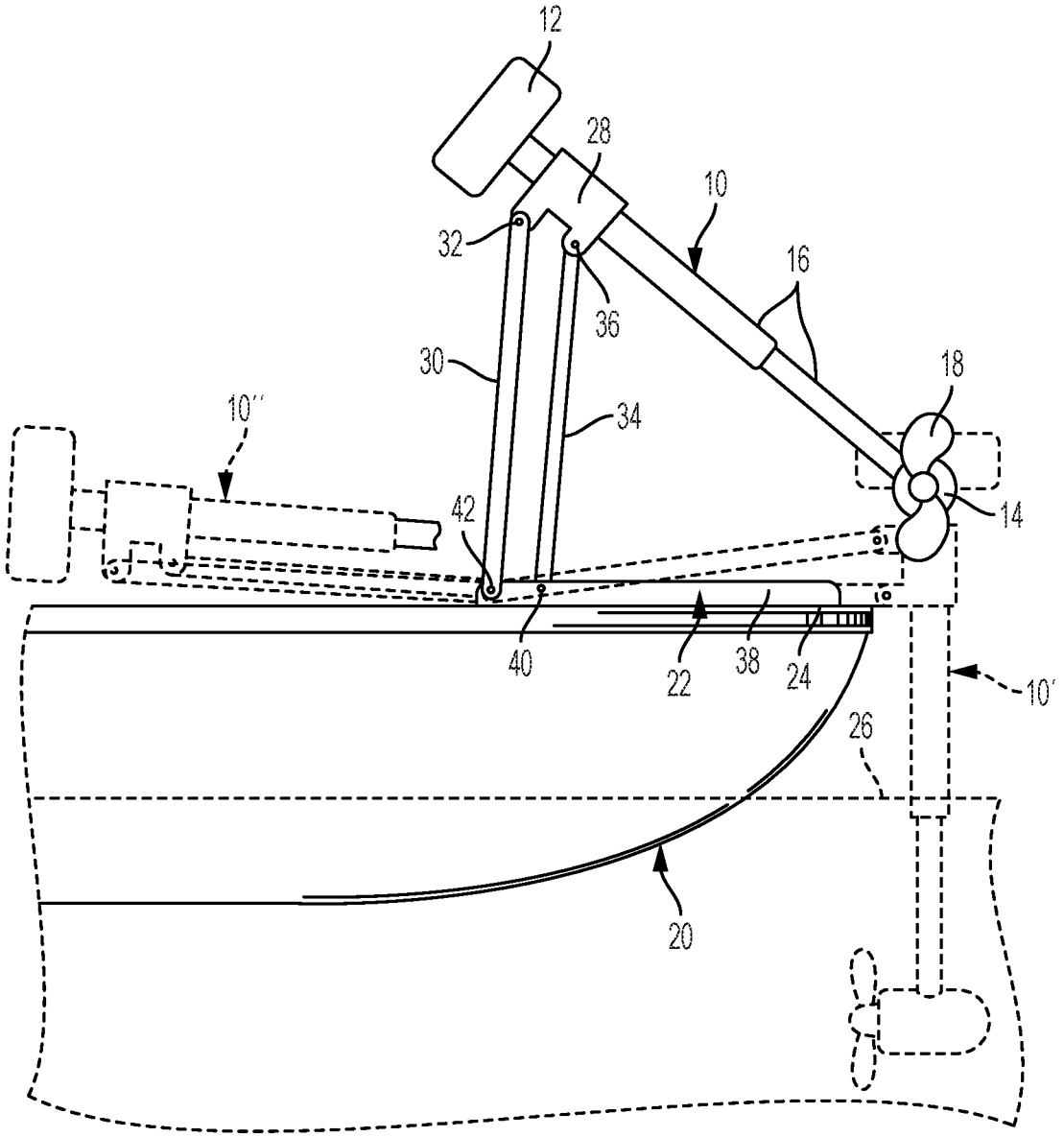
FIG. 1 PRIOR ART
FIG. 1 illustrates a trolling motor mounted to a watercraft according to one example of the prior art.

FIG. 1 illustrates a trolling motor 10 comprising a head unit 12, a propulsion unit 14, and a shaft 16 coupling the head unit 12 to the propulsion unit 14. The shaft 16 can be two parts as shown herein, or can be a single shaft extending between the head unit 12 and the propulsion unit 14. As is known, the propulsion unit 14 contains an electric motor that powers a propeller 18 in order to provide thrust to the watercraft 20 to which the trolling motor 10 is mounted. A mount 22 is configured to couple the shaft 16 to a deck 24 of the watercraft 20 and to pivot the trolling motor 10 between a deployed position, shown at 10', and a stowed position, shown at 10". In the stowed position, the trolling motor 10" lies generally parallel to the deck 24 of the watercraft 20 (i.e., horizontally), while in the deployed position, the trolling motor 10' is generally perpendicular to the deck 24 (i.e., vertical), and the propulsion unit 14 is located below the surface of the water 26.

The mount 22 comprises a four-pivot (four-bar) linkage including a bracket 28 holding the shaft 16, un upper arm 30 coupled to the bracket 28 at a first pivot 32, a lower arm 34 coupled to the bracket 28 at a second pivot 36, and a base 38 coupled to the lower arm 34 at a third pivot 40 and to the upper arm 30 at a fourth pivot 42. Such a four-pivot linkage-type mount 22 is known in the art for mounting trolling motors to bass fishing boats. Note, however, that the mount according to the present disclosure (to be described below) can be used with any type of trolling motor, including one having steering, speed, and direction controlled by a foot pedal, remote control, and/or tiller handle by way of mechanical and/or electronic signals. No matter how the trolling motor 10 is controlled, pivoting of the trolling motor 10 between the stowed and deployed positions is useful as it allows an operator of the watercraft 20 to move the trolling motor 10 in and out of the water 26, such as when the operator is using a different propulsion device to move more quickly through the water 26, when the operator is storing the watercraft 20 at a dock or elsewhere, when the operator is servicing the motor or propeller 18 of the propulsion unit 14, when the watercraft 20 is loaded on a trailer, etc.

Generally, in such four-pivot linkage-type mounts, a locking mechanism is provided to maintain the trolling motor 10 in the deployed position and to hold the trolling motor 10 in place while the trolling motor 10 produces thrust to propel the watercraft 20 through the water 26. Known trolling motor mounts of this kind have locking mechanisms that are located on the lower arm 34, which lock the lower arm 34 to the base 38. However, through research and development, the present inventors have determined that such a configuration permits the four-pivot linkage to twist excessively within the mount 22. Such twisting contributes to accelerated wear on the pivots 32, 36, 40, 42 and undesirable mount noise. Mount twisting is also considered undesirable because it contributes to less responsive boat maneuvering and makes the mount 22 appear weak or unstable. As the present inventors have realized, while it is the lower arm 34 that is traditionally locked to the base 38, a majority of the load from the trolling motor 10, created by the thrust from the propeller 18 as well as any input steering motions, is actually transmitted through the upper arm 30 and pivots 32, 42 associated with the upper arm 30.

Additionally, known trolling motors include locking mechanisms comprising bars that extend perpendicularly to the lower arm 34 and slide into and out of slots in the base 38 in order to lock the lower arm 34 to the base 38. The bar can be spring-loaded, and when actuated, is pushed into the slot to lock the components together, or pulled out of the slot to release the components from one another. Through research and development, the present inventors have learned that the bar-to-slot engagement can bind, making the locking mechanism difficult to actuate. This is especially true when any grease initially provided on the bar and/or slot deteriorates or washes away, after which the user experiences difficulty when releasing the locking mechanism. Over time, loads imposed by thrust forces from the propulsion unit 14 cause deterioration of the bar and/or slot, which contributes to excessive movement (shaking, twisting) of the trolling motor 10 with respect to the mount 22. As noted hereinabove, such movement presents challenges to the operator, among which include excessive noise and a sense that the mount 22 is weak or not functioning properly.

Thus, the present inventors have developed several refinements to known mounts, which refinements hold the trolling motor 10 more securely within the mount 22, preventing such shaking, twisting, and relative movement, and therefore increasing the life and perceived strength of the mount 22. For example, a mount according to the present disclosure may include one of the following: (1) a deployed-position latch coupled to one of the upper arm 30 and the base 38 and a corresponding deployed-position striker pin coupled to the other of the upper arm 30 and the base 38 and configured to engage with the deployed-position latch in the deployed position of the trolling motor 10' to lock the upper arm 30 to the base 38; or (2) a pivotable latch (and, in some examples, an associated latch blocker) on one of the upper or lower arm 30, 34 and the base 38 and a corresponding striker pin on the other of the upper or lower arm 30, 34 and the base 38 and configured to engage with the pivotable latch in at least one of the deployed position and the stowed position of the trolling motor 10 so to lock the upper or lower arm 30, 34 to the base 38. These features will be described further herein below.

Figure 2:
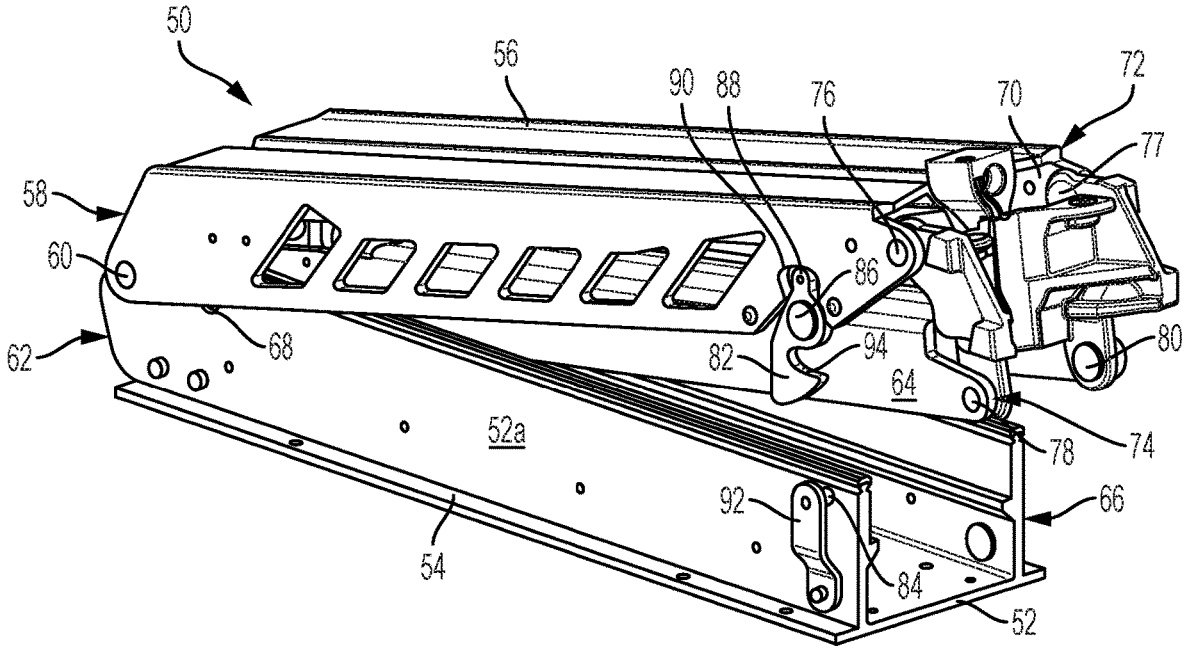
FIG. 2 illustrates one example of a mount for a trolling motor according to the present disclosure, with the mount in a nearly-deployed, unlocked position.

Now turning to FIG. 2, one example of a mount 50 for a trolling motor 10 configured to pivot the trolling motor 10 between a deployed position (see 10', FIG. 1) and a stowed position (see 10", FIG. 1) is shown. The mount 50 includes a base 52 configured to be coupled to the deck 24 of a watercraft 20, such as by bolting through a flange 54. The mount 50 includes an upper arm 56 having a first end 58 pivotably coupled at pivot 60 to a first end 62 of the base 52. The mount 50 also includes a lower arm 64 having a first end (not visible here, see 98, FIG. 3) pivotably coupled at pivot 68 to the base 52 between the first end 62 of the base 52 and an opposite, second end 66 of the base 52. The mount 50 also includes a bracket 70 coupling an opposite, second end 72 of the upper arm 56 to an opposite, second end 74 of the lower arm 64. Here, the bracket 70 is coupled to the upper arm 56 at pivot 76 and to the lower arm 64 at pivot 78. It should be understood from the drawings that the upper and lower arms 56, 64 have a width to them and are coupled at mirror-image pivots to both the bracket 70 and the base 52. For example, lower arm 64 is also coupled to bracket 70 at pivot 80, and upper arm 56 is also coupled to bracket 70 at pivot 77. When viewed from a side of the mount 50, pivot 80 is aligned with pivot 78 and pivot 77 is aligned with pivot 76, and the four pivots 76, 77, 78, 80 together allow pivoting of the upper arm 56 and lower arm 64 with respect to the bracket 70. Similar mirror-image pivots exist for pivots 60 and 68, as can be seen in FIG. 3.

In the example shown in FIG. 2, the mount 50 further comprises a deployed-position latch 82 coupled to the upper arm 56 and a corresponding deployed-position striker pin 84 coupled to the base 52 and configured to engage with the deployed-position latch 82 in the deployed position of the trolling motor 10' to lock the upper arm 56 to the base 52. Although the deployed-position latch 82 is shown as being coupled to the upper arm 56, note that the deployed-position latch 82 could instead be coupled to the base 52, in which case the deployed-position striker pin 84 would be coupled to the upper arm 56. The deployed-position latch 82 is coupled to the upper arm 56 at the second end 72 of the upper arm 56. More specifically, the deployed-position latch 82 is coupled to upper arm 56 at pivot 86 and includes a tab 88 located in a cutout 90 formed within upper arm 56. As deployed-position latch 82 rotates about pivot 86, it is prevented from moving more than a predetermined amount in either direction by engagement between tab 88 and cutout 90. The deployed-position striker pin 84 is coupled to the base 52 at the second end 66 of the base 52. More specifically, the deployed-position striker pin 84 is oriented generally perpendicularly with respect to a vertical wall 52*a* of the base 52, and is supported by a bracket 92, which may be bolted, welded, or otherwise connected to the vertical wall 52*a*.

Figure 2A:
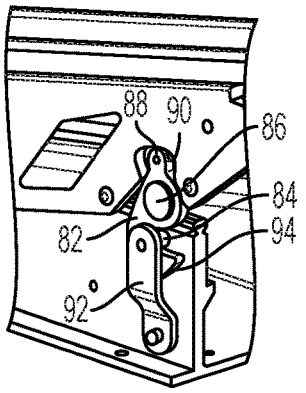
FIG. 2A shows a portion of the mount in FIG. 2, with the mount in a deployed, locked position.

The deployed-position latch 82 is pivotable about pivot 86, as noted hereinabove, and is also spring-biased about this pivot 86 into a locked position. As shown in FIG. 2A, in the locked position, the deployed-position striker pin 84 is received in a latching recess 94 of the deployed-position latch 82 when the trolling motor is in the deployed position 10'. The spring bias can be provided by way of a torsion spring provided around pivot 86, by way of another type of biasing mechanism known to those having ordinary skill in the art, or by way of biasing a connector 122 coupled to the tab 88, as will be described herein below.

Figure 3:
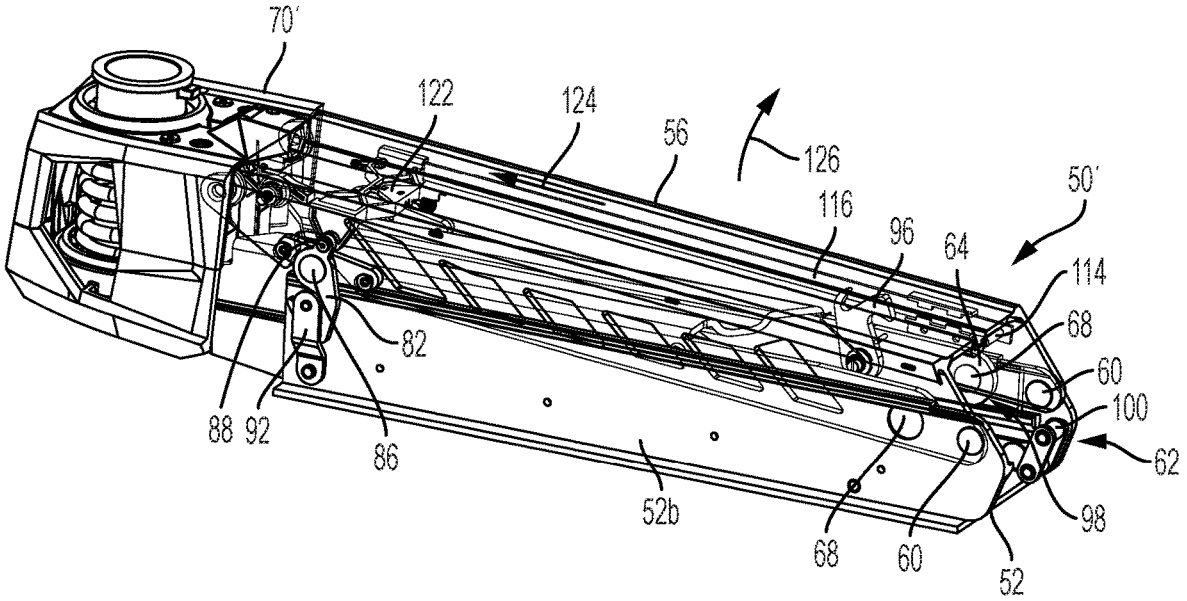
FIG. 3 illustrates another example of a mount for a trolling motor, with the mount in a deployed, locked position.
Figure 3A:
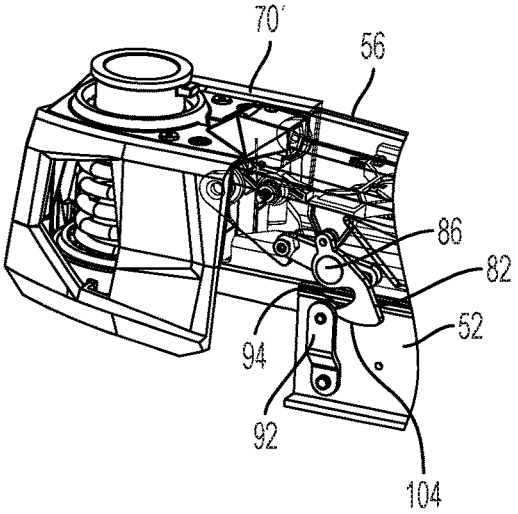
FIG. 3A shows a portion of the mount of FIG. 3, with the mount in an unlocked position.
Figure 3B:
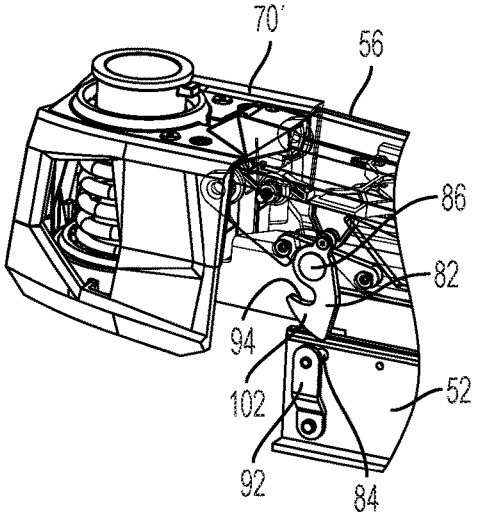
FIG. 3B shows the portion of the mount of FIG. 3, with the mount in a further unlocked position.

FIGS. 3, 3A, and 3B illustrate a mount 50' similar to the mount 50 of FIGS. 2 and 2A, except the bracket 70' is configured differently. All other components of the mount 50' are the same as those described with respect to the mount 50 and therefore will not be described in further detail. FIG. 3 does show, however, that a deployed-position latch 82 can additionally or alternatively be provided on an opposite side of the mount 50' for engagement with a deployed-position striker pin 84 held by bracket 92 on opposite vertical wall 52*b*. FIG. 3 also shows how the mount 50 or 50' may include a stowed-position latch 96 coupled to the lower arm 64 at the first end 98 of the lower arm 64. A corresponding stowed-position striker pin 100 is coupled to the base 52 at the first end 62 of the base 52 and is configured to engage with the stowed-position latch 96 in the stowed position of the trolling motor 10" to lock the lower arm 64 to the base 52, as will be described further herein below with respect to FIGS. 4, 4A, and 4B. Additionally, FIG. 3 shows how the pivots 60, 68 are provided on both sides of the upper and lower arms 56, 64, as noted hereinabove.

Turning to FIGS. 3A and 3B, the spring-biased nature of the deployed-position latch 82 will be further described. The deployed-position latch 82 is shown in its spring-biased position in FIG. 3B. In this position, were the upper arm 56 to be lowered to its lowest extent into the deployed position of the trolling motor 10', the deployed-position striker pin 84 would be received in the latching recess 94 of the deployed-position latch 82. However, before the upper arm 56 can be lowered to its lowest extent, the deployed-position latch 82 must be pivoted from the position shown in FIG. 3B such that the deployed-position striker pin 84 can be received in the latching recess 94. For this purpose, the deployed-position latch 82 is provided with a sliding surface 102 configured to engage with the deployed-position striker pin 84 as the trolling motor 10 pivots into the deployed position. Such engagement is shown at FIG. 3A, and rotates the deployed-position latch 82 counterclockwise against the spring bias and into a receiving position, in which the deployed-position striker pin 84 can enter the latching recess 94. Upon full lowering of the upper arm 56, the deployed-position latch 82 will be rotated clockwise by the spring bias back into the locked position, and the deployed-position striker pin 84 will be fully received within the latching recess 94, as shown in FIG. 3.

Review of FIGS. 2, 2A and 3, 3A, and 3B shows that the upper arm 56 compresses and traps the lower arm 64 in the base 52 when then trolling motor 10 is in the deployed position (see FIG. 1, 10'; FIG. 2A; and FIG. 3) and the upper arm 56 is locked to the base 52. Locking the upper arm 56 to the base 52 ensures that load from the propulsion unit 14 is adequately transferred from the bracket 70 or 70' through the upper arm 56 to the deck 24 of the watercraft 20. The lower arm 64, which in prior art arrangements is the arm locked to the base 52, is nonetheless still "locked" in position and able to transfer load by way of its compression between the upper arm 56 and the base 52.

Now turning to FIGS. 4, 4A, and 4B, details of the stowed-position latch 96 and stowed-position striker pin 100 will be described. The stowed-position latch 96 pivots about pivot 106 with respect to lower arm 64. The stowed-position latch 96 includes a latching recess 108, which is configured to receive the stowed-position striker pin 100. Such engagement of the latching recess 108 with the stowed-position striker pin 100 is shown in FIG. 4B. As the mount 50' is pivoted from the position shown in FIG. 4 to the position shown in FIG. 4A, a sliding surface 110 on the stowed-position latch 96 engages with the stowed-position striker pin 100, and rotates the stowed-position latch 96 about pivot 106 against a spring bias, which may for example be provided by a torsion spring, into a receiving position, in which the latching recess 108 is able to receive the stowed-position striker pin 100. The stowed-position striker pin 100 is shown at the beginning of this travel at one end of sliding surface 110 in FIG. 4, and at the end of this travel at the other end of sliding surface 110 in FIG. 4A, which represents the receiving position. Once the sliding surface 110 is no longer engaged with the stowed-position striker pin 100, the spring bias rotates the stowed-position latch 96 into a locked position, as shown in FIG. 4B. In this position, the stowed-position striker pin 100 is fully received in the latching recess 108.

Figure 4:
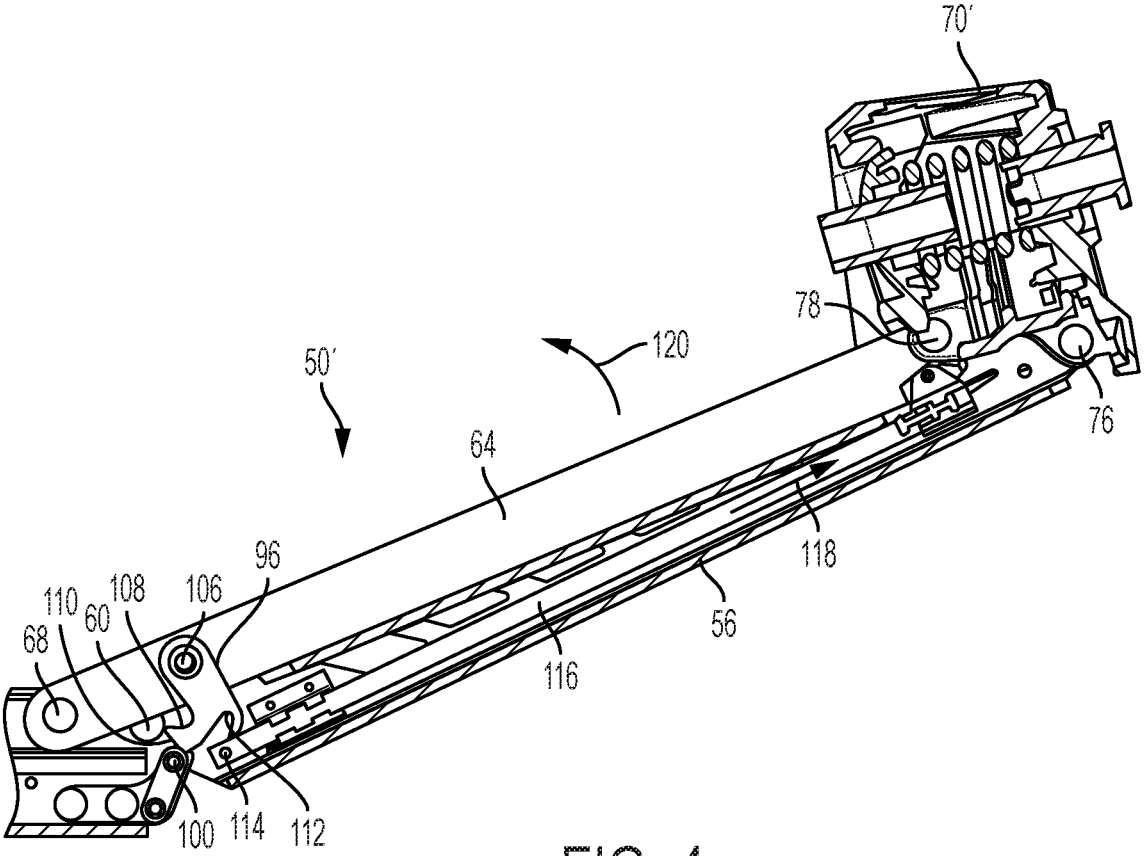
FIG. 4 illustrates the mount of FIG. 3, with the mount in a nearly-stowed, unlocked position.
Figure 4A:
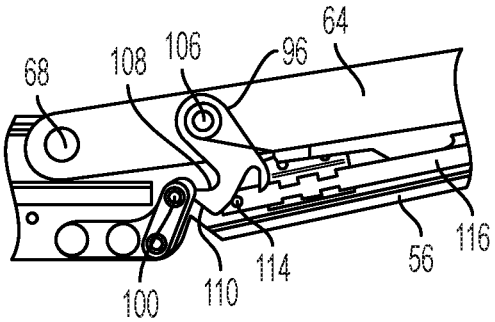
FIG. 4A shows a portion of the mount of FIG. 4, with the mount in another nearly-stowed, unlocked position.
Figure 4B:
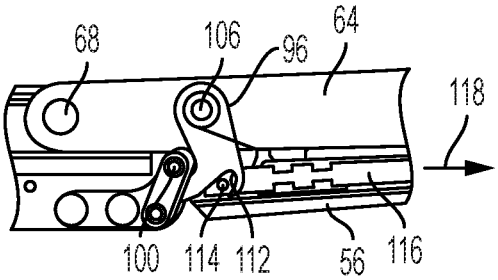
FIG. 4B shows the portion of the mount of FIG. 3, with the mount in a stowed, locked position.

Also of note in FIGS. 4, 4A, and 4B is that the stowed-position latch 96 includes another recess 112, which is configured to receive a release pin 114. The release pin 114 is provided at one end of a release mechanism 116, here in the form of a rod or bar, which can be used to release the stowed-position latch 96 from the locked position shown in FIG. 4B. To actuate the release mechanism 116, the release mechanism 116 is pulled in the direction of arrow 118 by way of a cord or other user-operated device connected to the release mechanism 116, which movement causes the release pin 114 to engage with the inner end of recess 112 on stowed-position latch 96. Further movement in the direction of arrow 118 forces the release pin 114 against the inner end of recess 112, which pivots the stowed-position latch 96 counterclockwise out of the locked position, disengaging the stowed-position striker pin 100 and latching recess 108 from one another. Such release thereafter allows the upper and lower arms 56, 64 to be rotated in the direction of arrow 120, back into the deployed position.

Referring back to FIG. 3, it should be noted that the release mechanism 116, when actuated, is configured to disengage both the deployed-position latch 82 from the deployed-position striker pin 84 and the stowed-position latch 96 from the stowed-position striker pin 100. Disengagement of the stowed-position latch 96 was previously described above. The release mechanism 116 is able to release the deployed-position latch 82 from the deployed-position striker pin 84 by way of a connector 122 extending laterally across the mount 50' just below the surface of upper arm 56. In an example in which two deployed-position latches are provided, one side of the connector 122 is coupled to the tab 88 on the deployed-position latch 82 on one lateral side of the mount 50', and the other side of the connector 122 is coupled to the tab 88 on the deployed-position latch 82 on the other lateral side of the mount 50'. The connector 122 is also coupled to one end of the release mechanism 116. When the release mechanism 116 is pulled in the direction of arrow 124, this causes the connector 122 also to move in the direction of arrow 124, thereby pivoting the tab(s) 88 within the cutout(s) 90 toward the bracket 70'. Such pivoting is about pivot 86 and rotates the deployed-position latch 82 counterclockwise against its spring bias, disengaging the latching recess 94 from the deployed-position striker pin 84, as shown in FIG. 3A. Once these two surfaces have been disengaged, as shown in FIG. 3B, the mount 50' is able to be rotated in the direction of arrow 126 toward the stowed position.

Thus, the same release mechanism 116 can be used to release both the stowed and deployed-position latches 96, 82. A single cord, pull handle, lever, or similar device can be used to actuate the release mechanism 116. In alternative embodiments, the release mechanism 116 could be a cord or a wire, instead of a rod as shown herein. Also note that instead of providing a torsion spring at pivot 86, deployed-position latch 82 could be biased by way of a spring connected to connector 122, which would tend to pull the connector 122 away from the bracket 70', thereby biasing the deployed-position latch 82 into the above-noted locked position.

Figure 5:
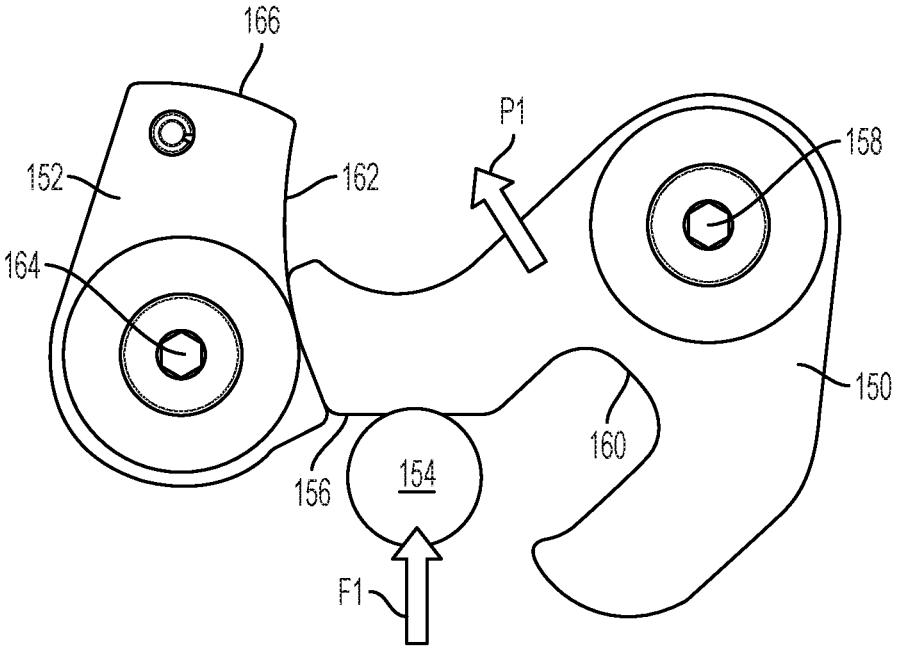
FIG. 5 illustrates a deployed-position latch and blocker assembly for a trolling motor, with the assembly in an unlocked position.
Figure 6:
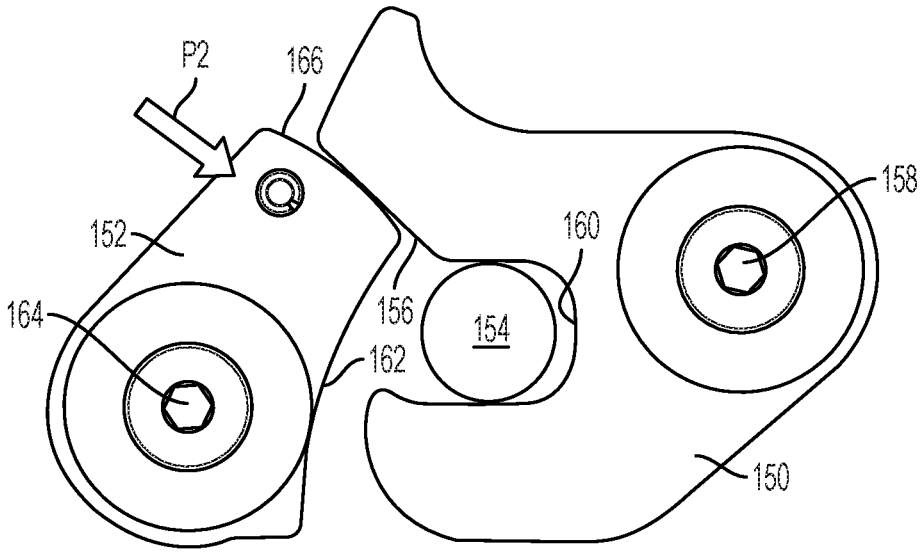
FIG. 6 illustrates the latch and blocker of FIG. 5 in a locked position.

In the above-described examples, the deployed-position latch 82 and the stowed-position latch 96 are pivotable, but are not associated with latch blockers. In other examples, the deployed-position latch 82 and/or the stowed-position latch 96 could be associated with a latch blocker, as will be described below. FIGS. 5 and 6 illustrate one example of a pivotable deployed-position latch 150 and an associated latch blocker 152, as well as a corresponding striker pin 154 with which the latch 150 is to be engaged. Note that the latch 150 could be provided on the upper arm 56, as described in the embodiments shown hereinabove, or on the lower arm 64, as is known in prior art mounts. The striker pin 154 would then be provided on the base 52. In alternative embodiments, the striker pin 154 could be provided on the upper or lower arm 56, 64, while the deployed-position latch 150 and associated latch blocker 152 could be provided on the base 52.

By comparison of FIG. 5 with FIG. 6, which latter figure shows the deployed-position latch 150 in a locked position, it can be seen that the latch blocker 152 contacts the pivotable latch 150 in both a locked position and an unlocked position of the pivotable latch 150 with respect to the striker pin 154. Referring to FIG. 5, as the latch 150 moves from the unlocked position to the locked position, a sliding surface 156 on the latch 150 experiences a force F1 due to contact with the striker pin 154. Such force F1 tends to pivot the pivotable latch 150 about pivot 158 in the direction of arrow P1, thereby allowing the striker pin 154 to enter the latching recess 160 of the pivotable latch 150. Throughout this pivoting shown by P1, the pivotable latch 150 slides along sliding surface 162 of latch blocker 152. However, once the pivotable latch 150 has pivoted such that it is no longer in contact with sliding surface 162 of latch blocker 152, the latch blocker 152 pivots about pivot 164 in the direction of arrow P2, according to a spring bias. In the resulting position shown in FIG. 6, the latch 150 receives the striker pin 154 in the latching recess 160, and a camming surface 166 of the latch blocker 152 contacts the pivotable latch 150 in this locked position. The camming surface 166 has a radius of curvature with a center that is offset somewhere to the left of the pivot 164 of the latch blocker 152. The location of the center of the radius of curvature of the camming surface 166 is offset enough that any relative movement of the assembly in the locked position will cause the latch blocker 152 to move slightly in the direction of arrow P2 and lock the latch 150 tighter around the striker pin 154. At the same time, the center of the radius of curvature of the camming surface 166 is carefully selected so that the pivotable latch 150 will not push the latch blocker 152 out of place when the assembly is in the locked position shown in FIG. 6.

To release the striker pin 154 from the pivotable latch 150, the latch blocker 152 is forcibly pivoted in a direction opposite the arrow P2, whereafter the pivotable latch 150 is allowed to rotate in a counter-clockwise direction and thereby release the striker pin 154 from the latching recess 160. The pivotable latch 150 is spring loaded, for example by way of a torsion spring, such that the pivotable latch 150 automatically rotates to the unlocked position upon disengagement from the striker pin 154.

Figure 7:
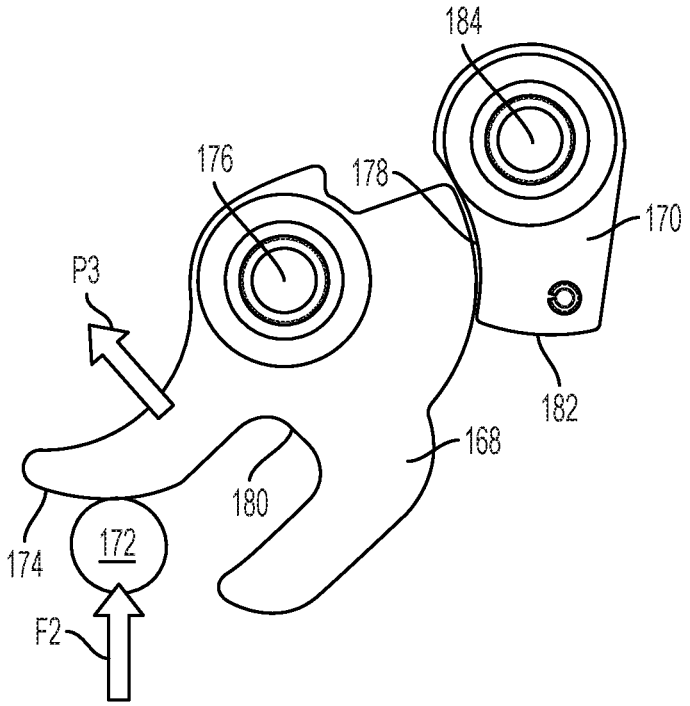
FIG. 7 illustrates a stowed-position latch and blocker assembly for a trolling motor, with the assembly in an unlocked position.
Figure 8:
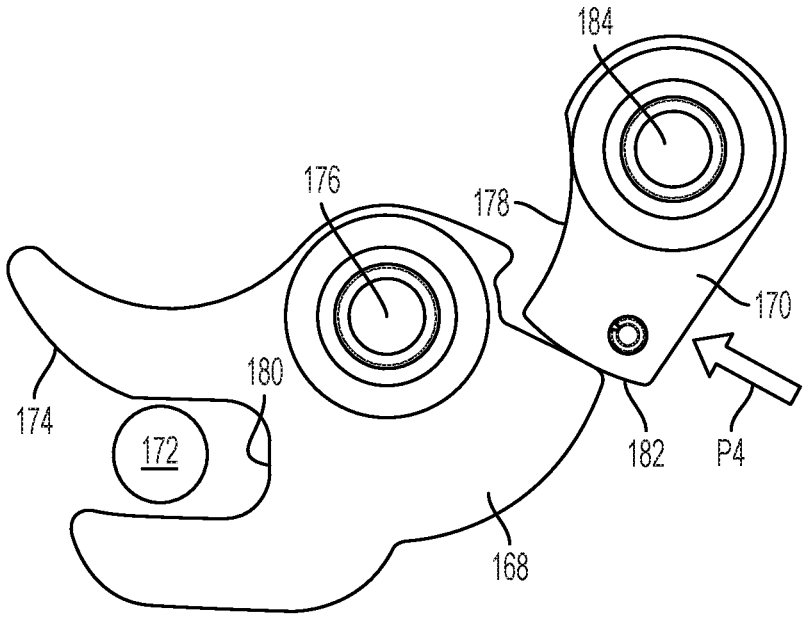
FIG. 8 illustrates the latch and blocker of FIG. 7 in a locked position.

The pivotable latch 150 and latch blocker 152 shown in FIGS. 5 and 6 are a first pivotable latch 150, an associated first latch blocker 152, and a first striker pin 154 configured to lock the upper or lower arm 56, 64 to the base 52 in the deployed position of the trolling motor 10'. Turning to FIGS. 7 and 8, a second pivotable latch 168, an associated second latch blocker 170, and a second striker pin 172 may be provided, and are configured to lock the upper or lower arm 56, 64 to the base 52 in the stowed position of the trolling motor 10". Such second pivotable latch 168, latch blocker 170, and striker pin 172 would be provided at the appropriate locations noted hereinabove with respect to FIGS. 4, 4A, and 4B.

FIG. 7 shows the stowed-position pivotable latch 168 in an unlocked position. Upon engagement of the striker pin 172 with a sliding surface 174 of the pivotable latch 168, and the force F2 provided thereby, the pivotable latch 168 will pivot about pivot 176 in the direction of arrow P3, as it slides along sliding surface 178 of latch blocker 170. Such pivoting in the direction of arrow P3 will eventually cause the striker pin 172 to be received within a latching recess 180 of the pivotable latch 168. At this point, as shown in FIG. 8, the sliding surface 178 on latch blocker 170 will no longer be in contact with the latch 168, and camming surface 182 on latch blocker 170 will engage with the pivotable latch 168 in order to hold the pivotable latch in the locked position. Similar to the description provided with respect to FIGS. 5 and 6, the latch blocker 170 rotates about pivot 184, which is not the same as the center of the radius of curvature of the camming surface 182, which center is instead somewhere to the right of the pivot 184. The latch blocker 170 is spring biased to pivot in the direction of arrow P4 in order to provide such engagement of the camming surface 182 with the pivotable latch 168. Thus, in order to release the pivotable latch 168 from the locked position, the latch blocker 170 is forcibly pivoted around pivot 184 in a direction opposite that of the arrow P4, and a spring bias of the pivotable latch 168 rotates it in the counter-clockwise direction out of engagement with the striker pin 172.

The latch and blocker arrangements, complete with the camming surfaces 166, 182 on the latch blockers 152, 170, ensure that any movement of the mount 22, 50, 50' in the stowed or deployed position only makes the engagement of the latches 150, 168 with their respective striker pins 154, 172 even tighter. Such tighter connections mean that the mount 22, 50, 50' overall is quieter, as the latch and striker pin connections will not loosen up over time. Additionally, such tighter connections drive more load from the trolling motor 10 through the latches 150, 168 rather than through the pivots 158, 176, meaning that the mount 22, 50, 50' appears to be (and is) more stable. Less play/clearance between the mount components results in a stiffer system, in which thrust from propulsion unit 14 is applied more quickly to the watercraft 20. Additionally, the steel-on-steel connection between the latches 150, 168 with the striker pins 154, 172 is durable, and any wear that the striker pins 154, 172 tend to cause to the latching recesses 160, 180 of the respective latches 150, 168 will be made up for by the tightening provided by the camming surfaces 166, 182.

Thus, it can be seen that by using a deployed-position latch that connects an upper arm of a mount to a base thereof, and/or using pivotable latches associated with latch blockers, a trolling motor mount can be made much more stable, durable, and easier to lock and unlock than mounts currently available. Note that, as indicated herein above, the latch and blocker arrangements of FIGS. 5-8 can be used with the prior art mount 22 of FIG. 1 or with the mounts 50, 50' according to the present disclosure shown in FIGS. 2-4. Additionally, it should be apparent that the latch arrangements in FIGS. 2-4 could be used without blockers, as shown.

In the present description, certain terms have been used for brevity, clarity, and understanding. No unnecessary limitations are to be implied therefrom beyond the requirement of the prior art because such terms are used for descriptive purposes only and are intended to be broadly construed. The different systems described herein may be used alone or in combination with other systems. Various equivalents, alternatives, and modifications are possible within the scope of the appended claims. Each limitation in the appended claims is intended to invoke interpretation under 35 USC § 112(f), only if the terms "means for" or "step for" are explicitly recited in the respective limitation.

What is claimed is:

1. A mount for a trolling motor configured to pivot the trolling motor between a deployed position and a stowed position, the mount comprising:

a base configured to be coupled to a deck of a watercraft;

an upper arm having a first end pivotably coupled to a first end of the base;

a lower arm having a first end pivotably coupled to the base between the first end of the base and an opposite, second end of the base;

a bracket coupling an opposite, second end of the upper arm to an opposite, second end of the lower arm;

wherein the mount further comprises one of the following:

a deployed-position latch connected to one of the upper arm and the base and a corresponding deployed-position striker pin connected to the other of the upper arm and the base and configured to engage with the deployed-position latch in the deployed position of the trolling motor to lock the upper arm to the base; and a pivotable latch and an associated latch blocker on one of the upper or lower arm and the base and a corresponding striker pin on the other of the upper or lower arm and the base and configured to engage with the pivotable latch in at least one of the deployed position and the stowed position of the trolling motor so as to lock the upper or lower arm to the base.

2. The mount of claim 1, wherein the mount comprises the deployed-position latch;

wherein the deployed-position latch is connected to the upper arm at the second end of the upper arm; and wherein the deployed-position striker pin is connected to the base at the second end of the base; and further comprising:

a stowed-position latch connected to the lower arm at the first end of the lower arm; and a stowed-position striker pin connected to the base at the first end of the base and configured to engage with the stowed-position latch in the stowed position of the trolling motor to lock the lower arm to the base.

3. The mount of claim 2, further comprising a release mechanism that, when actuated, is configured to disengage the deployed-position latch from the deployed-position striker pin and to disengage the stowed-position latch from the stowed-position striker pin.

4. The mount of claim 1, wherein:

the mount comprises the deployed-position latch;

the deployed-position latch is pivotable with respect to the one of the upper arm and the base to which the deployed-position latch is connected; and the deployed-position latch is spring-biased into a locked position, in which the deployed-position striker pin is received in a latching recess of the deployed-position latch when the trolling motor is in the deployed position.

5. The mount of claim 4, wherein the deployed-position latch has a sliding surface configured to engage with the deployed-position striker pin as the trolling motor pivots into the deployed position, which engagement rotates the pivotable deployed-position latch with respect to the one of the upper arm and the base against the spring bias and into a receiving position in which the deployed-position striker pin can enter the latching recess.

6. A trolling motor comprising:

a head unit;

a propulsion unit;

a shaft coupling the head unit to the propulsion unit; and a mount configured to couple the shaft to a deck of a watercraft and to pivot the trolling motor between a deployed position and a stowed position;

wherein the mount comprises a four-pivot linkage including a bracket holding the shaft, an upper arm coupled to the bracket at a first pivot, a lower arm coupled to the bracket at a second pivot, and a base coupled to the lower arm at a third pivot and to the upper arm at a fourth pivot; and wherein the mount further comprises one of the following:

a deployed-position latch coupled to one of the upper arm and the base and a corresponding deployed-position striker pin coupled to the other of the upper arm and the base and configured to engage with the deployed-position latch in the deployed position of the trolling motor to lock the upper arm to the base; and a pivotable latch on one of the upper or lower arm and the base and a corresponding striker pin on the other of the upper or lower arm and the base and configured to engage with the pivotable latch in at least one of the deployed position and the stowed position of the trolling motor so as to lock the upper or lower arm to the base.

7. The trolling motor of claim 6, further comprising:

a first pivotable latch and a first striker pin configured to lock the upper or lower arm to the base in the deployed position of the trolling motor; and a second pivotable latch and a second striker pin configured to lock the upper or lower arm to the base in the stowed position of the trolling motor.

8. The trolling motor of claim 6, wherein the mount comprises the deployed-position latch, and further comprising:

a stowed-position latch coupled to the lower arm; and a stowed-position striker pin coupled to the base and configured to engage with the stowed-position latch in the stowed position of the trolling motor to lock the lower arm to the base.

9. The trolling motor of claim 8, further comprising a release mechanism that, when actuated, is configured to disengage the deployed-position latch from the deployed-position striker pin and to disengage the stowed-position latch from the stowed-position striker pin.

10. The trolling motor of claim 6, wherein:

the mount comprises the deployed-position latch;

the deployed-position latch is pivotable; and the deployed-position latch is spring-biased into a locked position, in which the deployed-position striker pin is received in a latching recess of the deployed-position latch when the trolling motor is in the deployed position.

11. The trolling motor of claim 10, wherein the deployed-position latch has a sliding surface configured to engage with the deployed-position striker pin as the trolling motor pivots into the deployed position, which engagement rotates the deployed-position latch against the spring bias and into a receiving position in which the deployed-position striker pin can enter the latching recess.

12. The trolling motor of claim 6, wherein the mount comprises the deployed-position latch, and wherein the upper arm compresses and traps the lower arm in the base when then trolling motor is in the deployed position and the upper arm is locked to the base.

* * * * *